United States Patent [19]

Köllmann et al.

[11] 4,437,721

[45] Mar. 20, 1984

[54] CONNECTION TERMINAL FOR ELECTRICAL CONDUCTORS

[75] Inventors: Hans-Josef Köllmann, Minden; Lothar Hennemann, Enger; Wolfgang Hohorst, Minden, all of Fed. Rep. of Germany

[73] Assignee: Wago Verwaltungsgesellschaft mit Beschrankter Haftung, Minden, Fed. Rep. of Germany

[21] Appl. No.: 300,447

[22] Filed: Sep. 8, 1981

[30] Foreign Application Priority Data

Sep. 11, 1980 [DE] Fed. Rep. of Germany ..... 3034570
Apr. 1, 1981 [DE] Fed. Rep. of Germany ..... 3112969

[51] Int. Cl.[3] ..... H01R 4/00

[52] U.S. Cl. ..... 339/97 P; 339/98; 339/198 GA

[58] Field of Search ..... 339/97 R, 97 P, 98, 339/99 R, 198 GA

[56] References Cited

U.S. PATENT DOCUMENTS 3,258,733 6/1966 Elm ..... 339/98
3,936,128 2/1976 D'Annessa et al. ..... 339/98
4,116,529 9/1978 Reynolds ..... 339/97 R
4,269,471 5/1981 Woertz ..... 339/198 GA

FOREIGN PATENT DOCUMENTS 1203921 9/1970 United Kingdom ..... 339/198 GA

*Primary Examiner*—John McQuade
*Assistant Examiner*—Paula Austin
*Attorney, Agent, or Firm*—Salter & Michaelson

[57] ABSTRACT

The invention concerns a terminal for the connection of electrical conductors with a fixed current carrying strip using a movable clamping spring. The clamping spring is mounted to be movable in the nature of a plunger and contacts the electrical conductor and the current strip simultaneously, and is arranged so that insulated conductors and conductors with the insulation removed can be connected, and the forces for moving the clamping spring are nevertheless able to remain relatively low. The plunger has clamping arms which engage the conductor in the manner of a fork, and an end portion of the plunger contacts the current carrying strip. The conductor is located in a seating which surrounds the conductor.

5 Claims, 7 Drawing Figures

Fig. 1
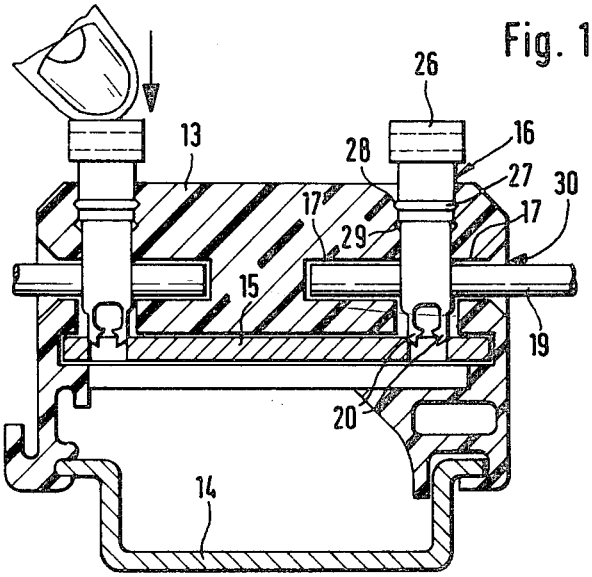
Fig. 2
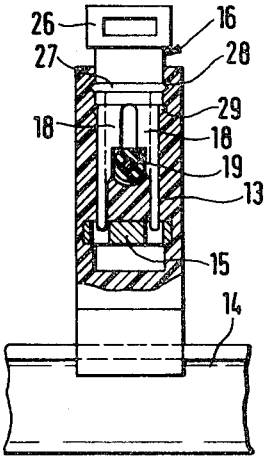
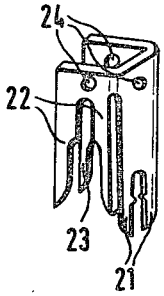
Fig. 3
Fig. 4
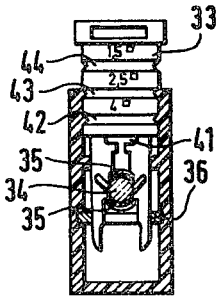

CONNECTION TERMINAL FOR ELECTRICAL CONDUCTORS

The invention concerns a terminal for the electrical connection of electrical conductors to a current carrying strip, the strip being arranged to be fixed within a body of insulating material. The terminal is for the mechanical and electrical clamping of at least one electrical conductor which can be inserted into the terminal through an opening in the insulating body.

In known terminals of this type a clamping spring forms a single constructional unit with the current strip, and the clamping spring clamps the electrical conductor against the current strip after insertion. Terminals of this type are suitable for conductors of various types such as, for example, for rigid conductors or for flexible single wire conductors. By loosening the clamping spring it is possible to withdraw the electrical conductor so that the terminal can be used repeatedly. Terminals of such a type, however, have the disadvantage that they can be used only for electrical conductors having the insulation removed.

It is an object of the invention to provide a terminal which can be used repeatedly for all kinds of conductor and which can be used for insulated conductors and for those with the insulation removed.

It is an additional object of the invention to make it possible for conductors of different cross-sections and with different cross-sectional tolerances to be used without there being risk of damage to the conductor and/or the need for the application of particularly large forces in manipulation of the terminal.

According to the invention a connection terminal for connecting at least one electrial conductor to a current carrying strip, comprises a body of insulating material in which the current carrying strip is arranged to be fixed and in which the electrical conductor is inserted, a clamping spring in the form of a plunger movably mounted in the insulating body to clamp the electrical conductor and make electrical contact therewith, the clamping spring having clamping arms of generally U shape which in the operative position engage the conductor in the manner of a fork and an end portion of the clamping spring making electrical contact with the current carrying strip, the conductor being located in a seating which surrounds the conductor and which is arranged to butt against opposite sides of the clamping spring.

Preferably the end portion of the clamping spring contacting the current carrying strip is constituted by the clamping arms.

By the use of a plunger which can be moved relative to the fixed strip it is possible to cut through and/or cut away the insulation of electrical conductors so that a good electrical contact is produced between the plunger and the electrical conductor. Since the plunger also makes electrical contact with the current strip at the same time the current connection between the electrical conductor and the strip is made along the shortest path.

If the clamping arms of the plunger contact the strip as illustrated in more detail in the drawings, then owing to the combination of the plunger with the strip there arises, from a mechanical point of view, the advantage that slight distortions of the plunger, such as may easily be produced during attachment to the terminal owing to a variable cross-section of the conductor, can be compensated for during subsequent attachment to the terminal by means of a guide provided by the strip so that the plunger can be re-used so that it remains optimally adjusted for each attachment to the terminal.

The plunger can be pulled away from the electrical conductor without difficulty for re-usage since the conductor is guided in the seating which surrounds it. If this seating is formed by the insulating material of the insulating body of the terminal alone and if the plunger contacts the strip in its forward operative position only than a clean break of the electrical connection between the electrical conductor and the strip is guaranteed when the plunger is withdrawn. In another form of embodiment of the invention it is possible, however, for the seating to be formed, at least in part, by the current carrying strip. This is particularly advantageous with confined space availability since the electrical conductor is then applied directly against the current strip and the constructional height of the terminal can be reduced.

It is advantageous to guide the plunger within the insulating body of the terminal within a channel provided externally with one open end since in this case the plunger can be easily interchanged. In this way the terminal according to the invention can be very easily adapted to different diameters of the electrical conductor.

On the other hand, a terminal according to the invention may, of course, be provided with a plurality of plungers or connection positions, each one of which is adjusted for a predetermined cross-section of conductor. Alternatively it is also possible for a single plunger to be provided with several clamping arm pairs for different cross-sections of conductor. In this case the plunger does not need to be changed when conductors of differing cross-sections are to be connected.

An advantageous embodiment of the invention provides that the clamping arms are symmetrical to one another and have internal edges which are graduated in stepped manner and which have sharp edges for removing insulation from the conductor, whereby the arms can make contact with conductors of different cross-sections. Such a terminal with one opening for insertion of the conductor for each connection position can be employed universally for conductors of different cross-sections.

For terminals which are to be capable of use for both insulated electrical conductors and for those with the insulation removed with varying cross-sections there arises the problem of adjusting the clamping force correctly so that, on the one hand, the electrical conductor is not cut or damaged during the clamping process and, on the other hand, that there is still a sufficiently large clamping force available to remove the insulation of the electrical conductor and to produce the necessary good electrical contact between the plunger and the conductor.

This problem is solved, in particular, in an embodiment of the invention in which the clamping arms are guided along their outer edges between spring loaded jaws defined by the current strip, said outer edges acting as cam surfaces whereby the clamping action of the jaws is dependent on the extent of travel of the plunger.

Particularly advantageous is an embodiment of the invention in which the clamping arms have inner cutting edges for cutting away the insulation of the conductor and succeeding clamping edges for making electrical contact with the conductor, the outer edges being arranged to generate the clamping action of the jaws as the clamping edges engage the conductor.

This latter embodiment of the invention further provides separation of the functions of cutting and of making electrical contact as the clamping force of the clamping jaws is substantially applied only after the cutting process. It is thereby possible to achieve an arrangement in which the cutter first cuts through the insulation of the electrical conductor with a relatively low spring-loaded setting of the clamping arms to touch the external contour of the conductor without producing any damage to it. In the process of touching varying conductor cross-sections are taken into consideration as well as their tolerances.

The clamping force is then increased only after the insulation of the conductor has been cut through and the clamping edges of the clamping arms have impinged on the now un-insulated electrical conductor. This increase in the clamping force is a function of the plunger travel and may be influenced as desired by a predetermined shape of the outer edges of the clamping arms.

It can be seen that by this means the forces needed for moving the plunger are low since the clamping adjustment of the plunger takes place only when the clamping edges are already applied against the conductor and they can then be moved into their end position with a relatively low force.

A convenient form of the invention provides that the inner edges of the clamping arms have cleaning edges intermediate the cutting edges and the clamping edges for cleaning the surface of the conductor. These cleaning edges or reamers operate sufficiently effectively with the gentle action of the clamping arms of the plunger that damage to the conductor is avoided.

The clamping force of the clamping arms and thus also the force needed for activation of the plunger are decreased further in that, according to another embodiment of the invention, the clamping arms are tapered in wedge form as viewed in the plane of the clamping forces. This wedge shape has the advantage that when used with insulated conductors the insulating casing is pushed away to each side in the axial direction of the conductor during the cutting process, which requires the application of a smaller force than, for example, a pure shearing process at right angles to the conductor direction.

Further features of the invention will appear from the following description of various embodiments of the invention given with reference to the drawings, in which:

FIG. 1 is a longitudinal section through a terminal,

FIG. 2 is a transverse section therethrough.

FIG. 3 is a perspective view of a plunger,

FIG. 4 is a cross-section through a terminal to which conductors of different cross-sections can be connected.

Figure 5:
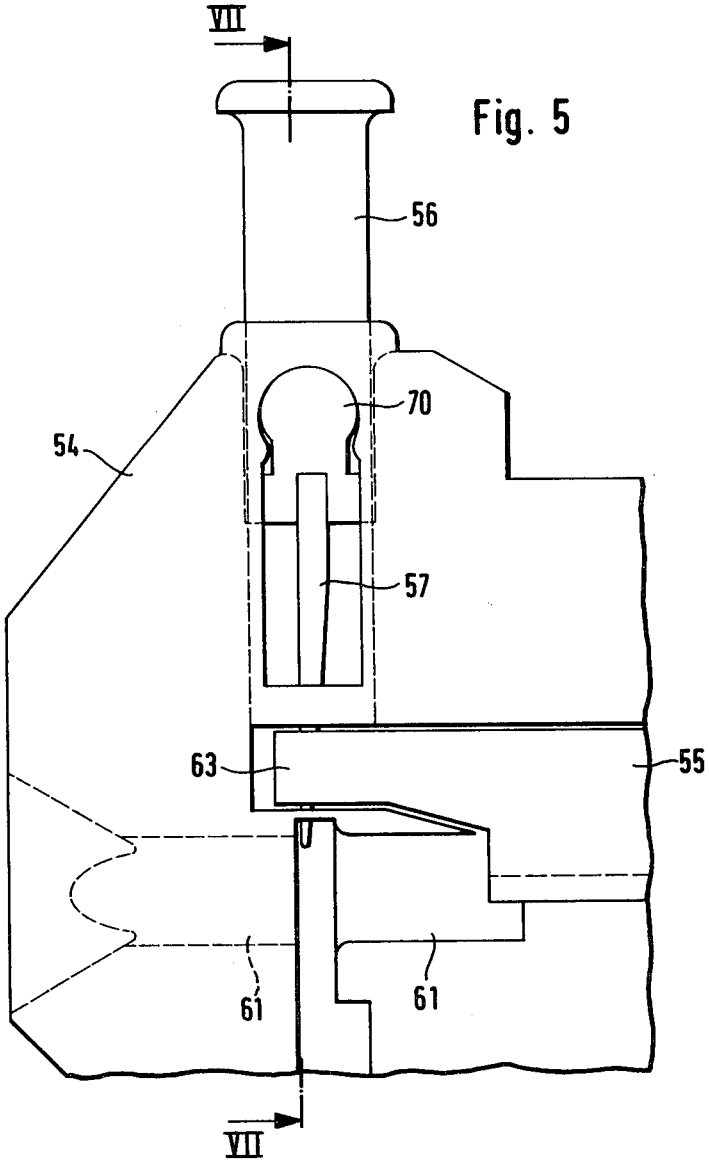
FIG. 5 is the side view of half of another embodiment of terminal.

The terminal illustrated in FIGS. 1 and 2 has a body 13 of insulating material which is locked onto a bearing rail 14 in known manner. A current carrying strip 15 is fixed within the insulating body 13. The terminal has two connection positions which are constructed identically. Each connection position includes a clamping spring or plunger 16, a conductor bed or seating 17 and the strip 15. As can be seen in FIG. 2 in particular, the plunger 16 has two sharp-edged clamping arms 18 mutually forming a U-shape which engage in the manner of a fork with an electrical conductor 19, provided with a casing of insulating material.

In addition the plunger 16 has end pieces 20 which are offset at 90 degrees to the plane of the clamping arm 18 and which serve to make contact with the strip 15. FIG. 3 shows an embodiment of plunger in which this is more easily seen. Ends 21 serve to contact the strip 15 and a pair of clamping arms 22 and 23, offset by 90 degrees relative to the ends 21, serve to engage with and contact the electrical conductor 19. Other forms of embodiment of the plunger are also possible. The plunger illustrated in FIG. 3 has bores 24 in its upper region which serve to make a reliable connection of the profiled metal part to a head part of insulating material.

The plunger 16 illustrated in FIGS. 1 and 2 has a head piece which can be located by means of a locking bead 27 in an upper notch 28 or a lower notch 29. When locked in the upper notch 28 the terminal position is open and the conductor 19 can be led in through the insertion opening 30 for the conductor. It is pushed forward up to its end position in its conductor bed 17 which is designed to butt at opposite sides against the plunger spring 16 and which encloses the electrical conductor on all sides.

When the locking bead 27 is locked in the lower notch 29 the plunger 16 is pushed forward far enough for the two sharp-edged clamping arms 18, arranged in a U-shape, to engage with the electrical conductor 19 in the manner of a fork and to make contact with the conductor after having previously cut through the casing of insulating material of the conductor 19. The conductor 19 is clamped in the upper narrow fork opening between the clamping arms 18. In this depressed operative position of the plunger the end pieces 20 make contact with the current strip 15.

The depression of the plunger spring 16 may take place by finger pressure (see FIG. 1) since the plunger is protected from finger contact by the insulating head 26. In order to disconnect the connection terminal it is only necessary for the plunger to be pulled back, for which purpose a screwdriver is conveniently inserted in a pocket of the insulating head 26.

Another embodiment of a connection terminal is illustrated in cross-section in FIG. 4. The illustrated cross-section passes through the position of a terminal and allows a plunger spring 33, an electrical conductor 34, a conductor bed or seating 35 and a current strip 36 to be seen. The plunger 33 shown here has clamping arms with stepwise graduations arranged symmetrically to one another, by means of which three differing cross-sections of conductor can be clamped with one and the same plunger. An exact adjustment of the force characteristics of the individual graduations or partial sections of the plunger spring is achieved by an arrangement of slots. The insulating head has stop beads 42, 43 and 44 corresponding with the graduations by means of which the plunger can be locked in three different positions corresponding to the cross-section of the conductor clamped at any time. The locking positions are indicated on the insulating head, for example 2.5□ for the conductor with a conductor cross-section of 2.5 $mm^2$ actually clamped, as illustrated in FIG. 4.

Figure 6:
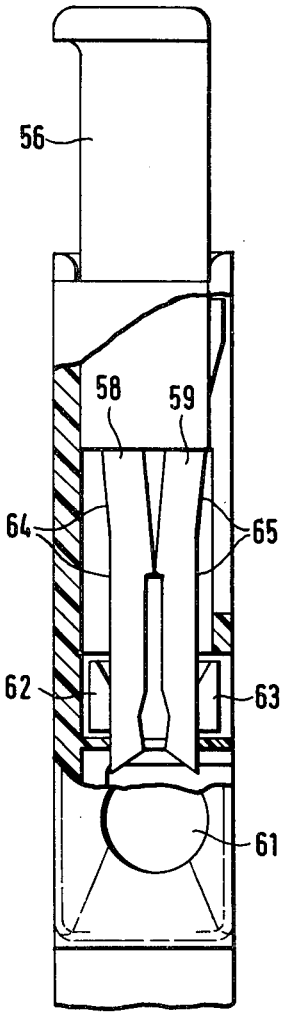
FIG. 6 is the front view of the terminal of FIG. 5 with partly cut away walls.
Figure 7:
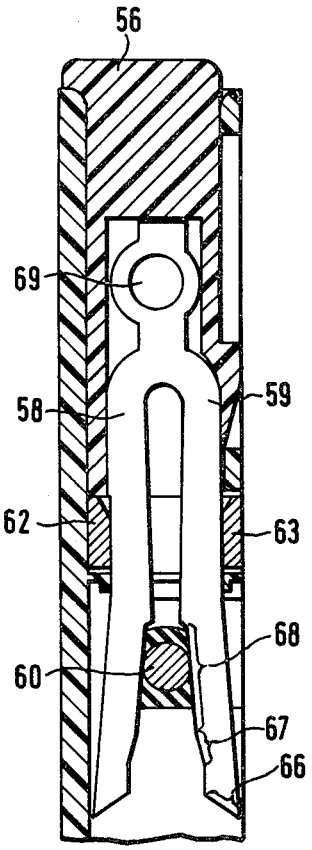
FIG. 7 is a cross-section through the terminal of FIG. 5 along the line VII—VII in FIG. 5.

The terminal illustrated in FIGS. 5–7 has an insulating body 54 with a current carrying strip 55 fixed in the insulating body and a clamping spring or plunger 57 mounted to be movable within the insulating body 54 by means of a plunger head 56. It can be seen from FIGS. 6 and 7 that the plunger 57 has two clamping arms 58 and 59 mutually arranged in the form of a U, and an electrical conductor 60 is guided in a conductor bed or seating 61 which encloses the conductor on all sides and which is designed to butt against the plunger at opposite sides when the plunger is in its depressed operative position.

The clamping arms 58 and 59 of the plunger 57 are led with their outer edges located between two spring-loaded clamping jaws 62 and 63 of the strip 55. The outer edges are formed as cams 64 and 65 and define the time and the magnitude of the clamping action of the clamping jaws as a function of plunger travel. In the profiling of the cams 64 and 65 account must be taken of the cross-sections, for example 0.75–1.5 $mm^2$, which the terminals are to accept and the size of the gap occupied by the clamping arms in the housing (compare FIG. 6).

In the illustrated embodiment of FIGS. 5–7 the size of the gap between the clamping arms 58 and 59 varies with the region of the arms which is operative at any one time. The clamping arms illustrated have, in each case, cutter edges 66, reamer edges 67 and clamping or contact edges 68.

It can be seen from FIG. 6 that a back taper increasing the size of the gap of the clamping arms is arranged in the plunger direction immediately behind the cutter edges 66.

When the plunger is pushed down onto an insulated electrical conductor 60 the cutter edges 66 first cut through the insulating casing. This leads only to a slight widening of the gap so that at first a light control of the clamping action and low clamping forces persist. The cams 64 and 65 are also arranged in such a way that over this operational region activation of an additional clamping force on the jaws remains suppressed.

Subsequent to this the reamer edges 67 machine and clean the surface of the exposed conductor 60. Then the contact edges 68 are pushed on to the electrical conductor and in this step a marked widening of the gap is produced and thus the desired increase in the clamping forces on the jaws. In addition the clamping forces on the jaws are now also applied due to the cams 64 and 65, so that the contact edges 68 of the conductor 60 make effective electrical contact independent of the conductor cross-section.

It can be seen from FIG. 5 that the plunger is arranged to taper in a wedge shape in the direction of movement of the plunger when seen in side view, that is in the plane of the clamping forces.

The plunger head 56 consists of insulating material and is firmly connected with the plunger 57 by means of the punch hole 69. In its withdrawn upper position it has a locking notch 70.

What we claim as our invention and desire to secure by Letters Patent of the United States is:

1. A connection terminal for an electrical conductor comprising:

a. a body made of an electrical insulating material, said body having a seat formed therein for receiving said conductor;

b. a current strip in said body; and c. a clamping spring movably mounted in said body, said clamping spring having a generally U-shaped portion which defines a pair of clamping arms, said clamping spring being movable in a plunger-like manner to an operative position wherein when said conductor is received in said seat the inner edges of said arms engage said conductor and the outer edges of said arms engage said strip to electrically connect said conductor to said strip through said arms.

2. In the connection terminal of claim 1, said clamping arms being of inwardly tapered, wedge-shaped cross-sectional configuration so that when the inner edges of said arms engage insulation on said conductor upon inward movement of said clamping spring said arms tend to separate said insulation by simultaneously urging it in opposite axial directions relative to said conductor.

3. In the connection terminal of claim 1, said current strip having a pair of resilient jaws, the outer edges of said clamping arms engaging said jaws to increasingly urge said arms into clamping engagement with said conductor upon inward advancement of said spring into said body.

4. In the connection terminal of claim 3, the inner edges of said clamping arms having cutting edge portions for cutting through insulation on said conductor and clamping edge portions for making electrical contact with said conductor, upon inward movement of said spring into said body, said cutting edge portions passing said conductor prior to the engagement of said conductor by said clamping edge portions, said jaws engaging said arms to urge them into clamping engagement with said conductor only when said clamping edge portions are adjacent said conductor.

5. In the connection terminal of claim 4, the inner edges of said clamping arms having cleaning edge portions between said cutting edge portions and said clamping edge portions.

* * * * *